US011929230B2

(12) United States Patent
Kasuya et al.

(10) Patent No.: US 11,929,230 B2
(45) Date of Patent: Mar. 12, 2024

(54) ELECTRON SOURCE AND CHARGED PARTICLE BEAM DEVICE

(71) Applicant: Hitachi High-Tech Corporation, Tokyo (JP)

(72) Inventors: Keigo Kasuya, Tokyo (JP); Akira Ikegami, Tokyo (JP); Kazuhiro Honda, Tokyo (JP); Masahiro Fukuta, Tokyo (JP); Takashi Doi, Tokyo (JP); Souichi Katagiri, Tokyo (JP); Aki Takei, Tokyo (JP); Soichiro Matsunaga, Tokyo (JP)

(73) Assignee: HITACHI HIGH-TECH CORPORATION, Tokyo (JP)

( * ) Notice: Subject to any disclaimer, the term of this patent is extended or adjusted under 35 U.S.C. 154(b) by 233 days.

(21) Appl. No.: 17/601,421

(22) PCT Filed: Apr. 18, 2019

(86) PCT No.: PCT/JP2019/016563
§ 371 (c)(1),
(2) Date: Oct. 4, 2021

(87) PCT Pub. No.: WO2020/213109
PCT Pub. Date: Oct. 22, 2020

(65) Prior Publication Data

US 2022/0199349 A1 Jun. 23, 2022

(51) Int. Cl.
*H01J 37/073* (2006.01)

(52) U.S. Cl.
CPC ..... *H01J 37/073* (2013.01)

(58) Field of Classification Search
CPC .. H01J 1/30; H01J 37/06; H01J 37/063; H01J 37/065; H01J 37/07; H01J 37/073
See application file for complete search history.

(56) References Cited

U.S. PATENT DOCUMENTS 8,957,390 B2 * 2/2015 Adamec ..... H01J 3/027 315/15

FOREIGN PATENT DOCUMENTS

EP 790633 A2 * 8/1997 ..... H01J 37/06
EP 790633 A2 8/1997
JP S57-096450 A 6/1982
(Continued)

OTHER PUBLICATIONS

International Search Report, PCT/JP2019/016563 dated Jul. 23, 2019 (4 pages).

(Continued)

*Primary Examiner* — David E Smith
(74) *Attorney, Agent, or Firm* — Volpe Koenig

(57) ABSTRACT

A large current electron beam is stably emitted from an electron gun of a charged particle beam device. The electron gun of the charged particle beam device includes: a SE tip 202; a suppressor 303 disposed rearward of a distal end of the SE tip; a cup-shaped extraction electrode 204 including a bottom surface and a cylindrical portion and enclosing the SE tip and the suppressor; and an insulator 208 holding the suppressor and the extraction electrode. A shield electrode 301 of a conductive metal having a cylindrical portion 302 is provided between the suppressor and the cylindrical portion of the extraction electrode. A voltage lower than a voltage of the SE tip is applied to the shield electrode.

13 Claims, 15 Drawing Sheets

(56) References Cited

FOREIGN PATENT DOCUMENTS

| | | | | |
|---|---|---|---|---|
| JP | 01260742 | A | * | 10/1989 |
| JP | H01-260742 | A | | 10/1989 |
| JP | H08-171879 | A | | 7/1996 |
| JP | 2012-033297 | A | | 2/2012 |
| JP | 2017-204342 | A | | 11/2017 |

OTHER PUBLICATIONS

Taiwan Office Action (Application No. 109106488, dated Sep. 22, 2020) (7 pages).
Korean Office Action dated Jul. 20, 2023 for Korean Patent Application No. 10-2021-7030924.
Chinese Office Action dated Jan. 10, 2024 for Chinese Patent Application No. 201980094952.5.

* cited by examiner

[FIG. 1]
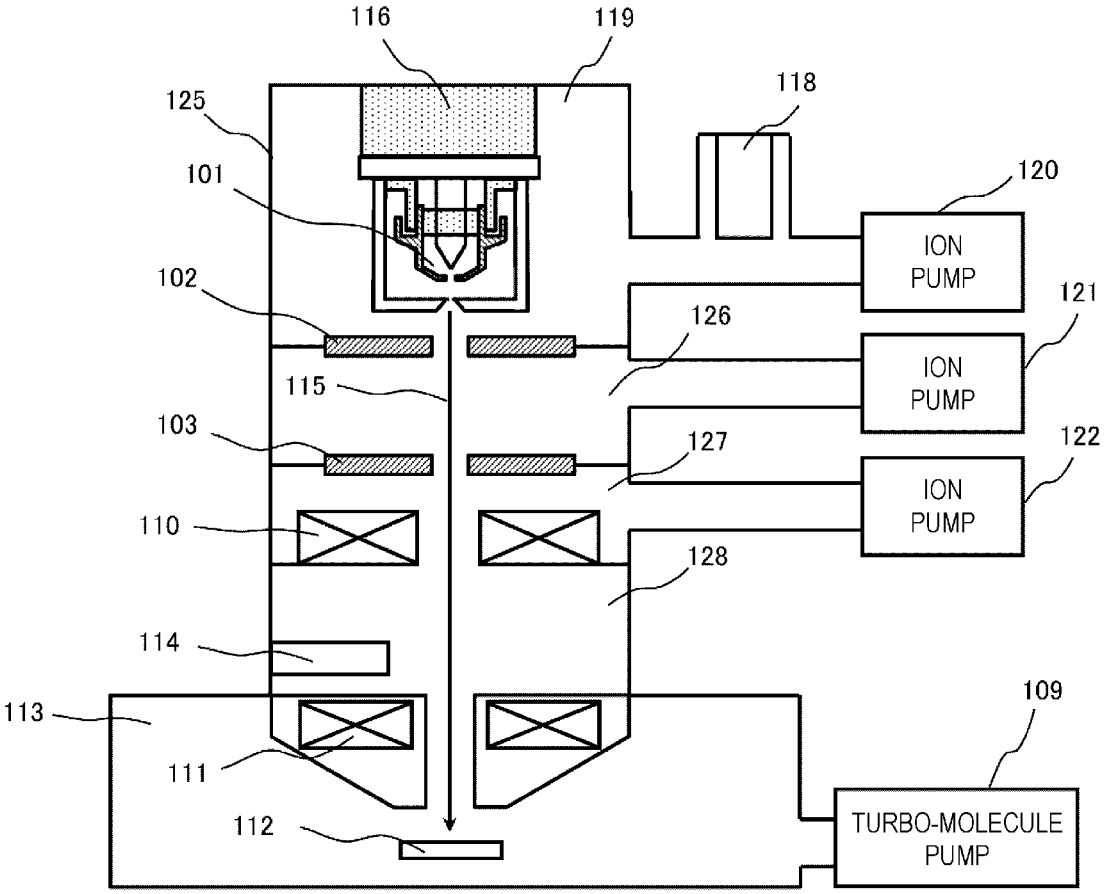

[FIG. 2]
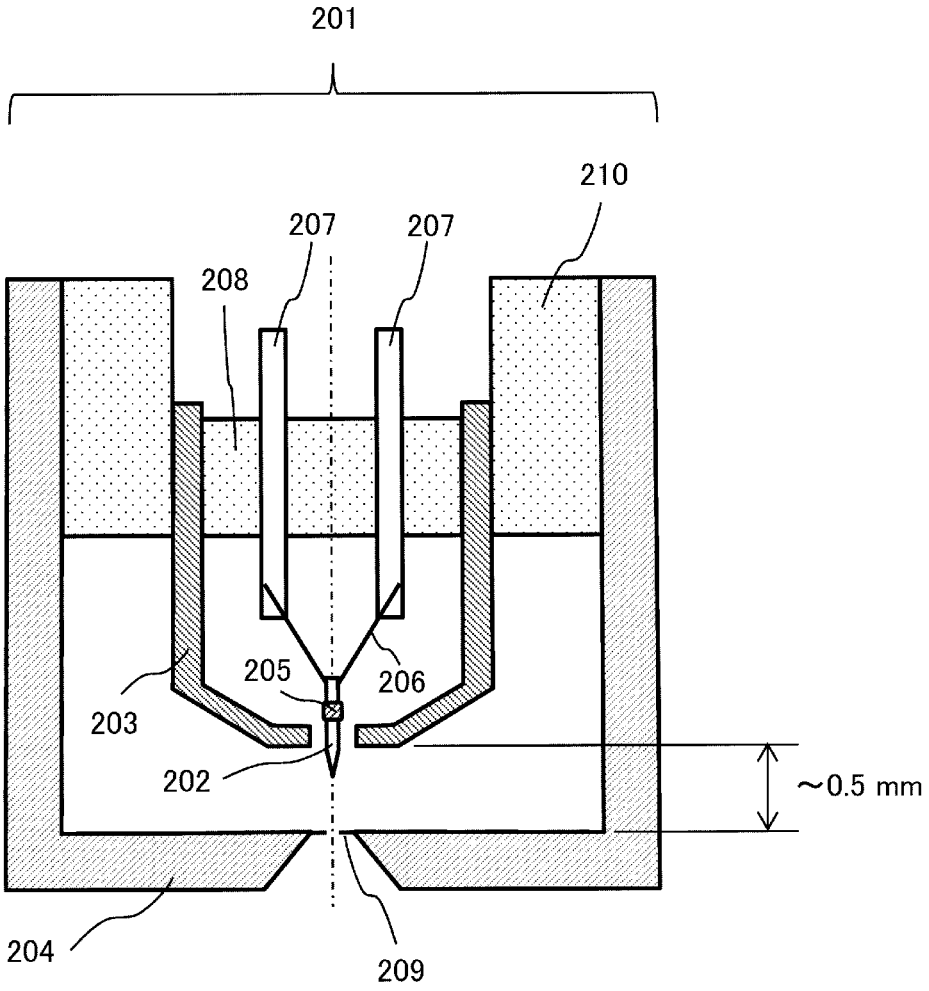

[FIG. 3A]
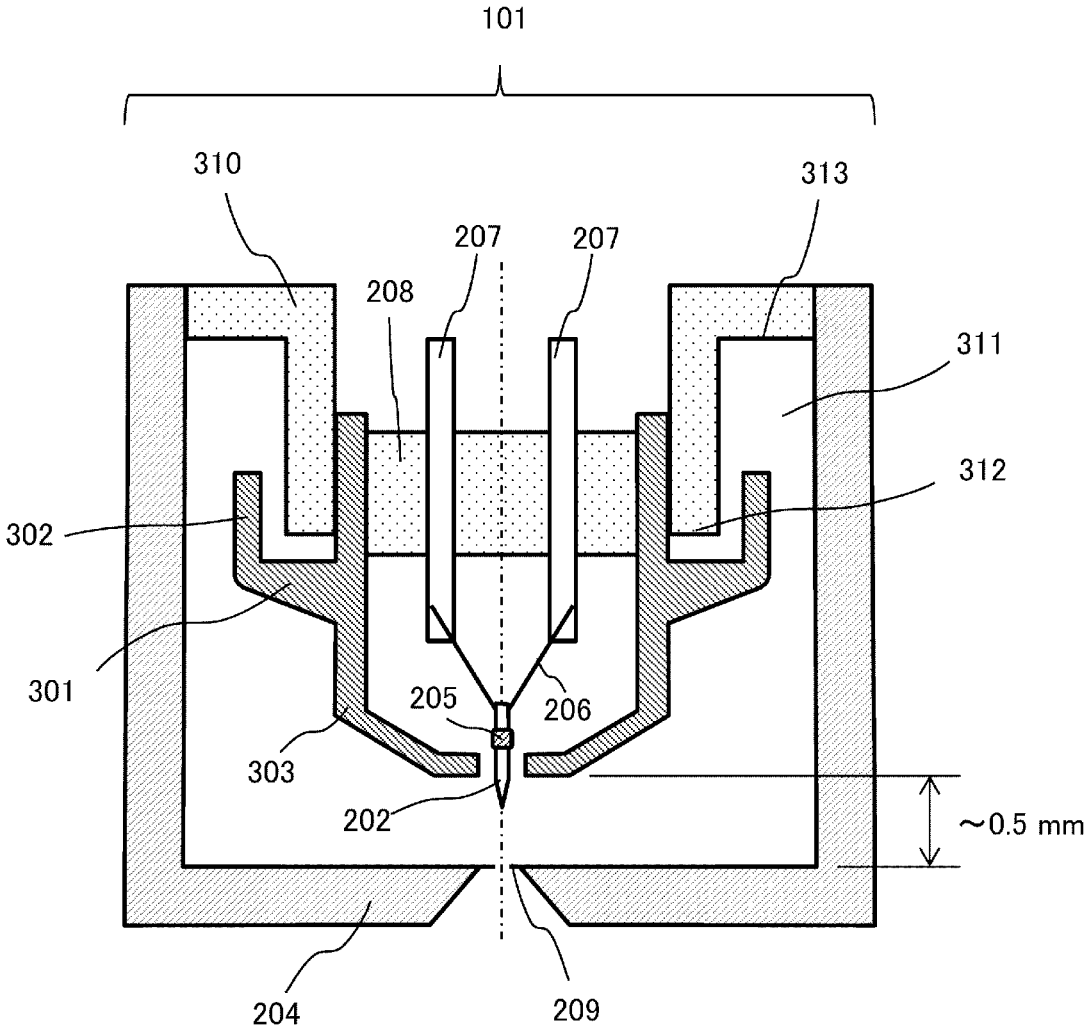

[FIG. 3B]
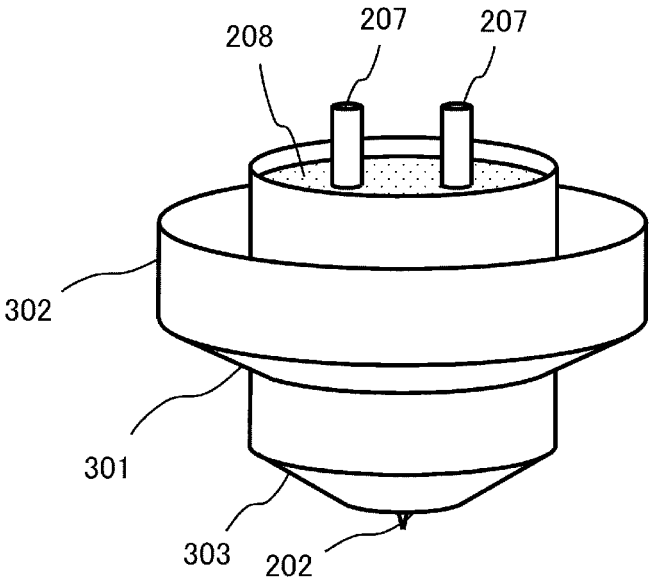

[FIG. 4]
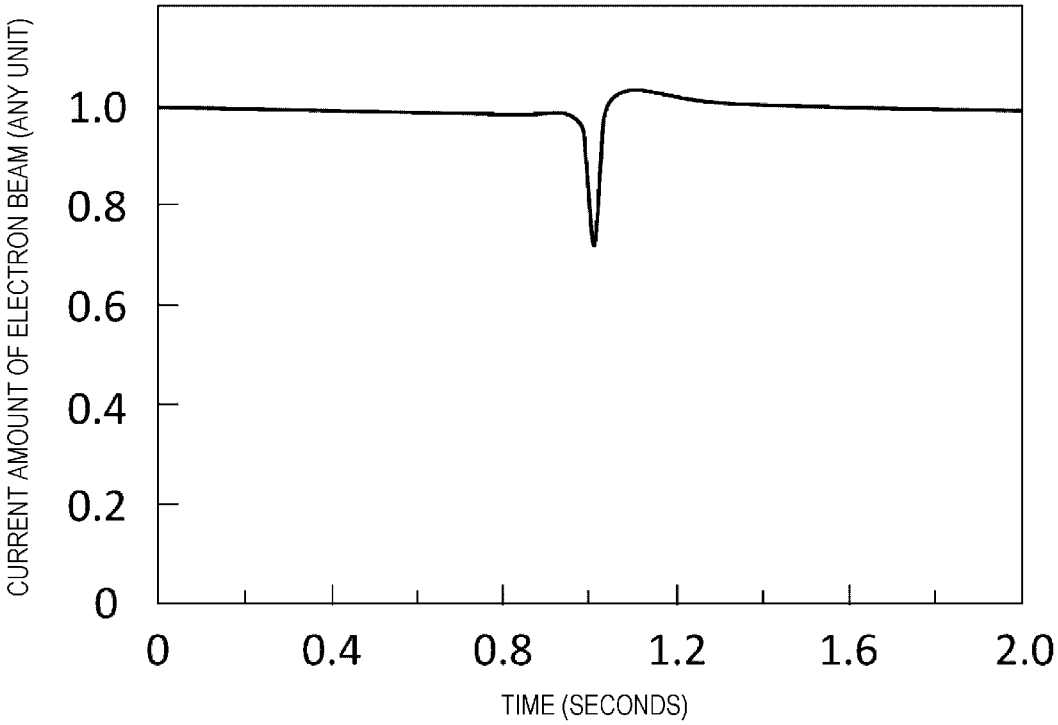

[FIG. 5]
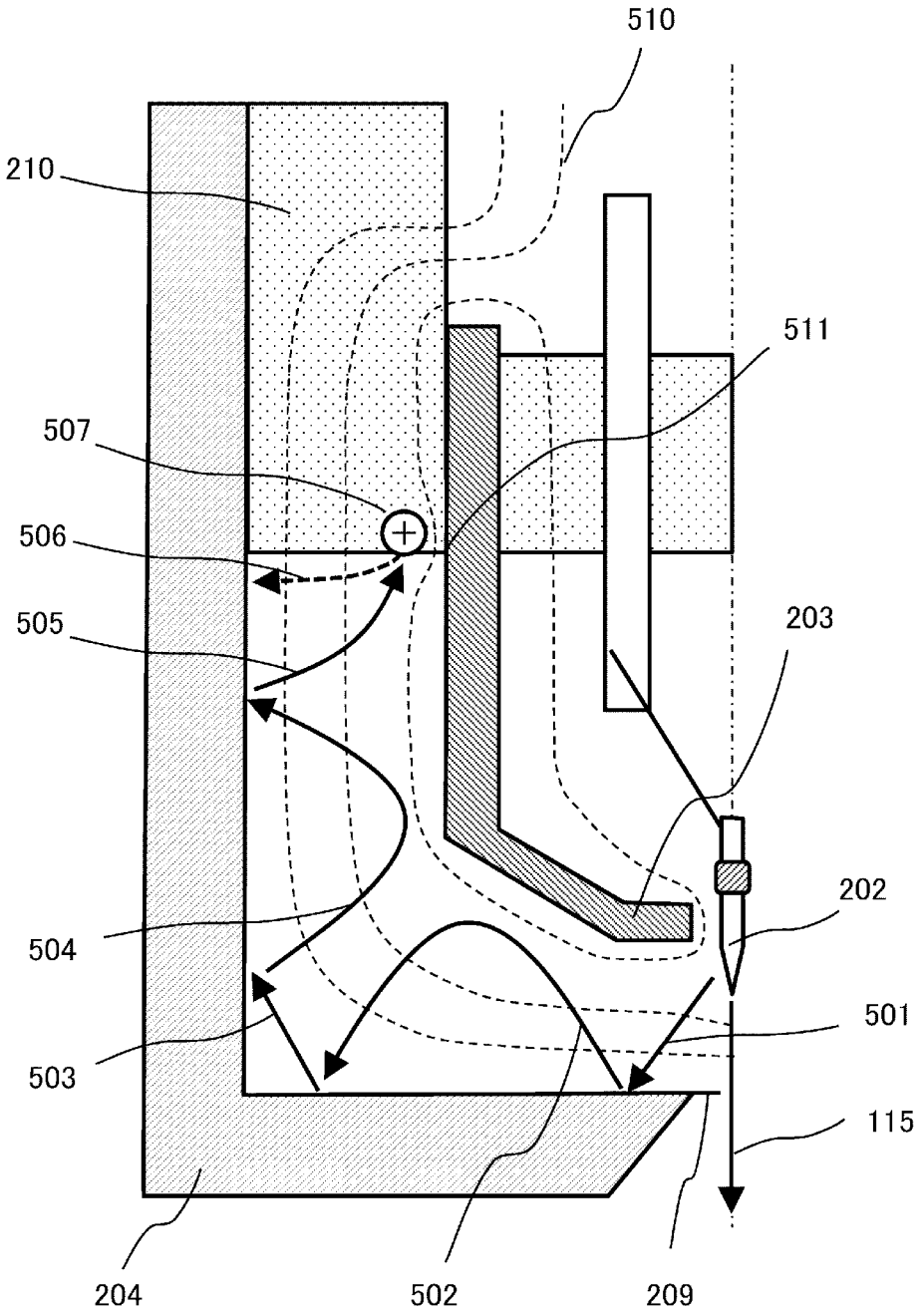

[FIG. 6]
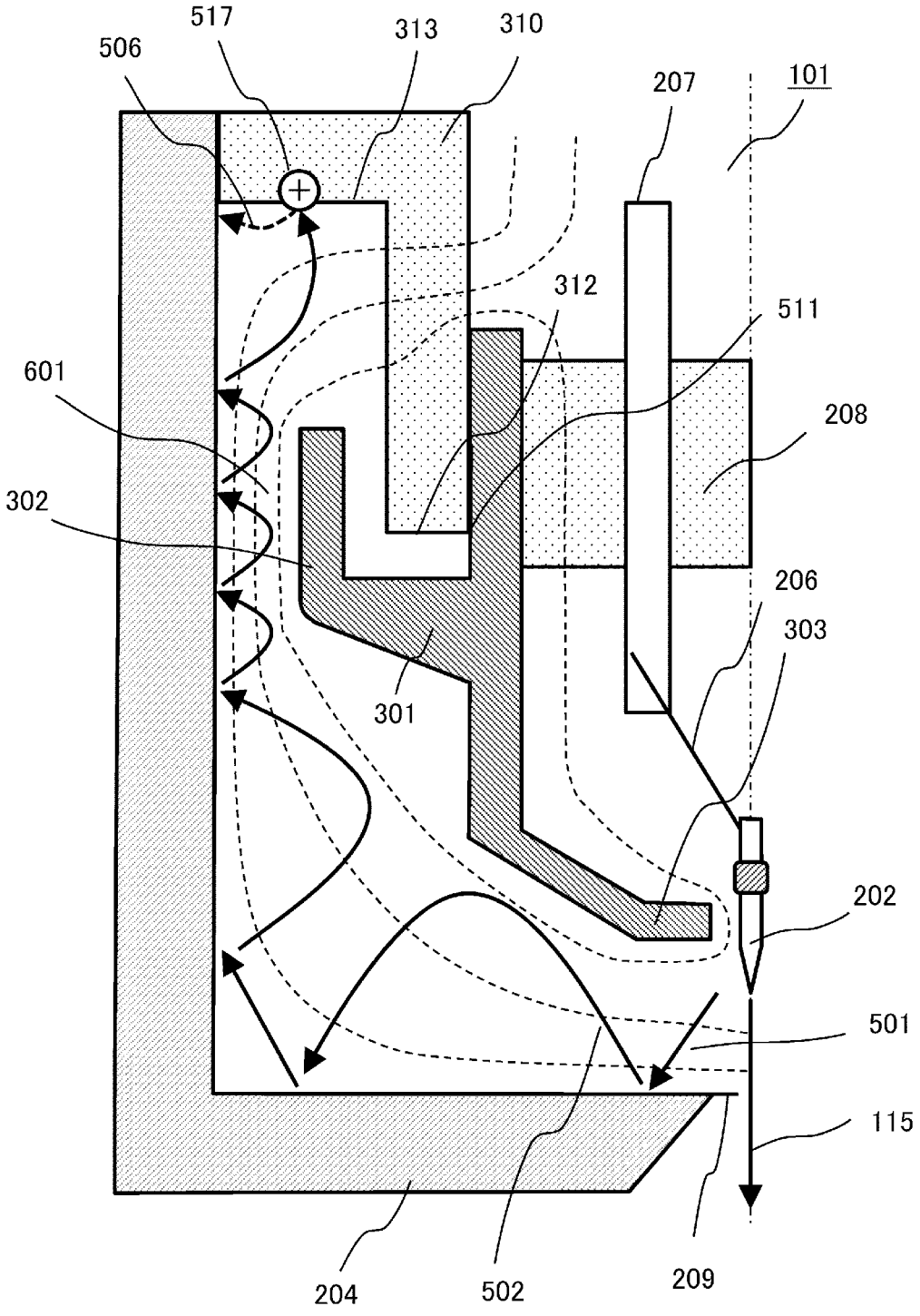

[FIG. 7]
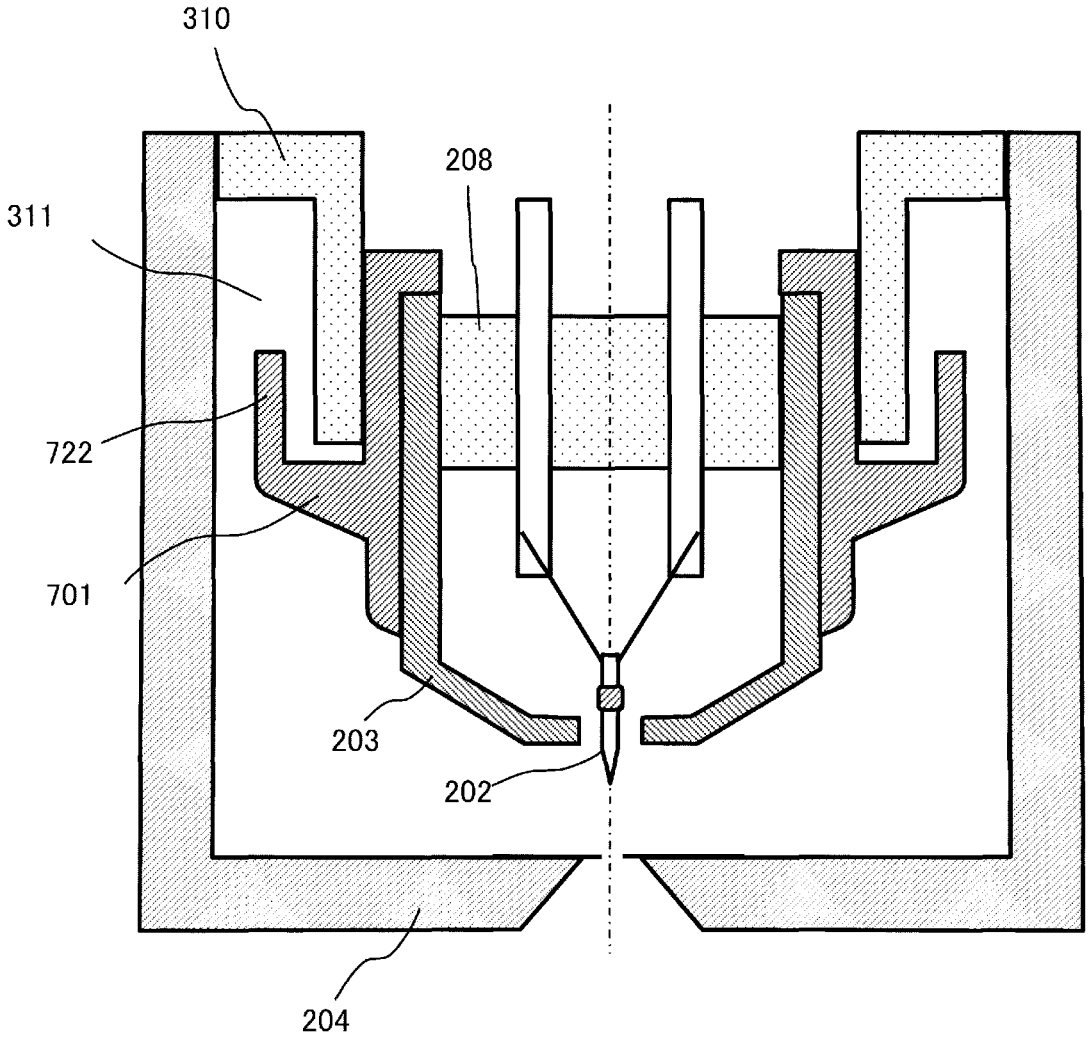

[FIG. 8]
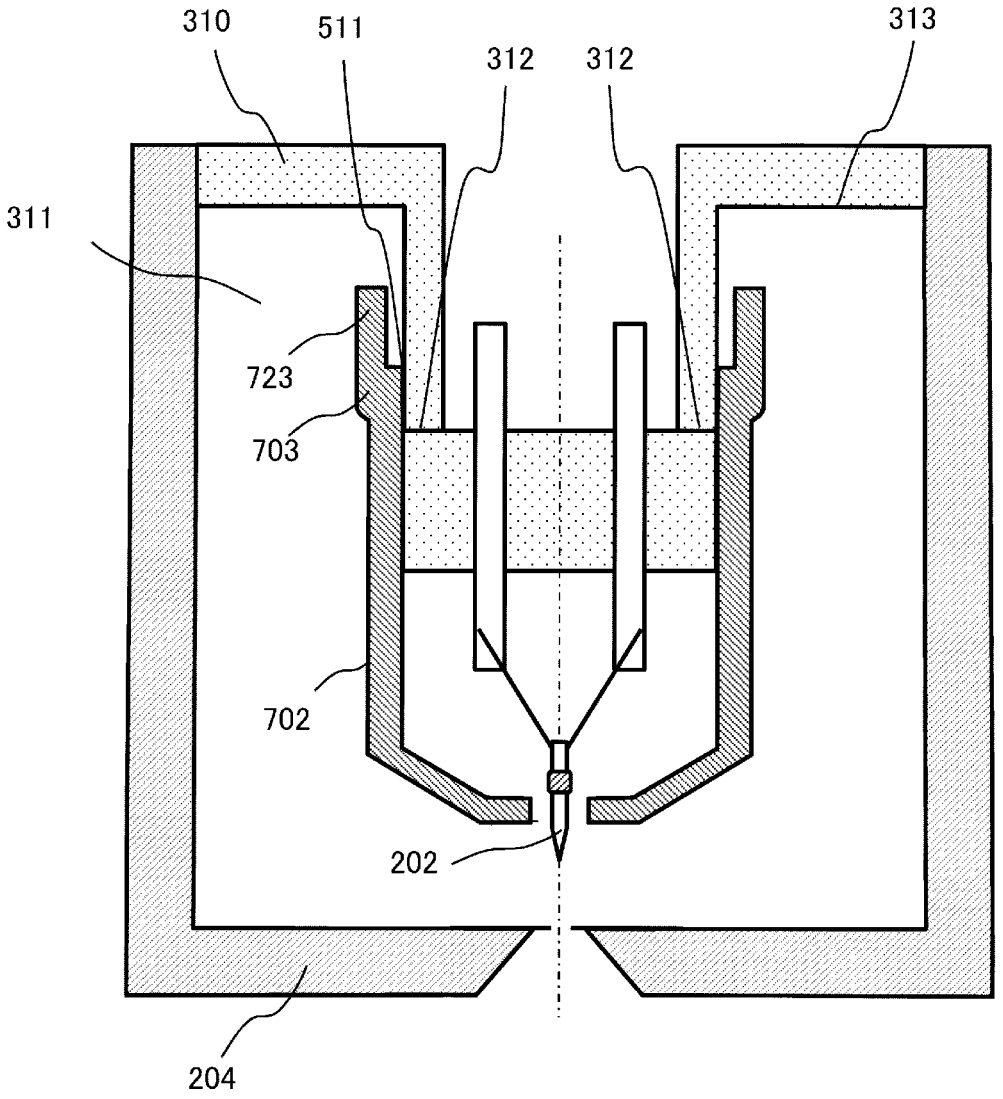

[FIG. 9]
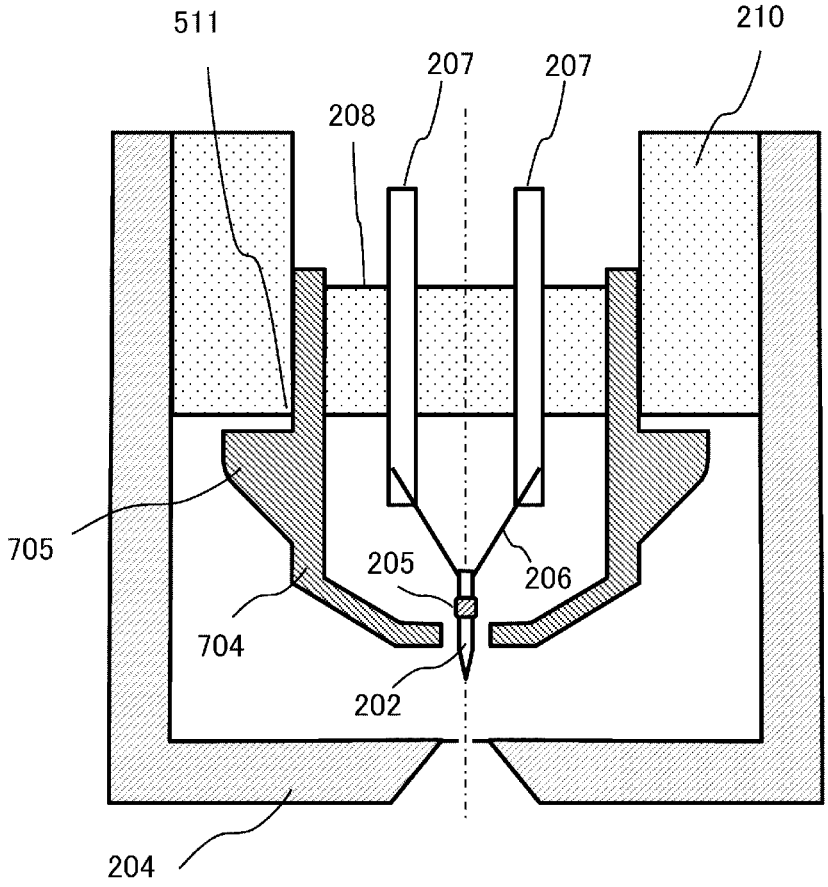

[FIG. 10]
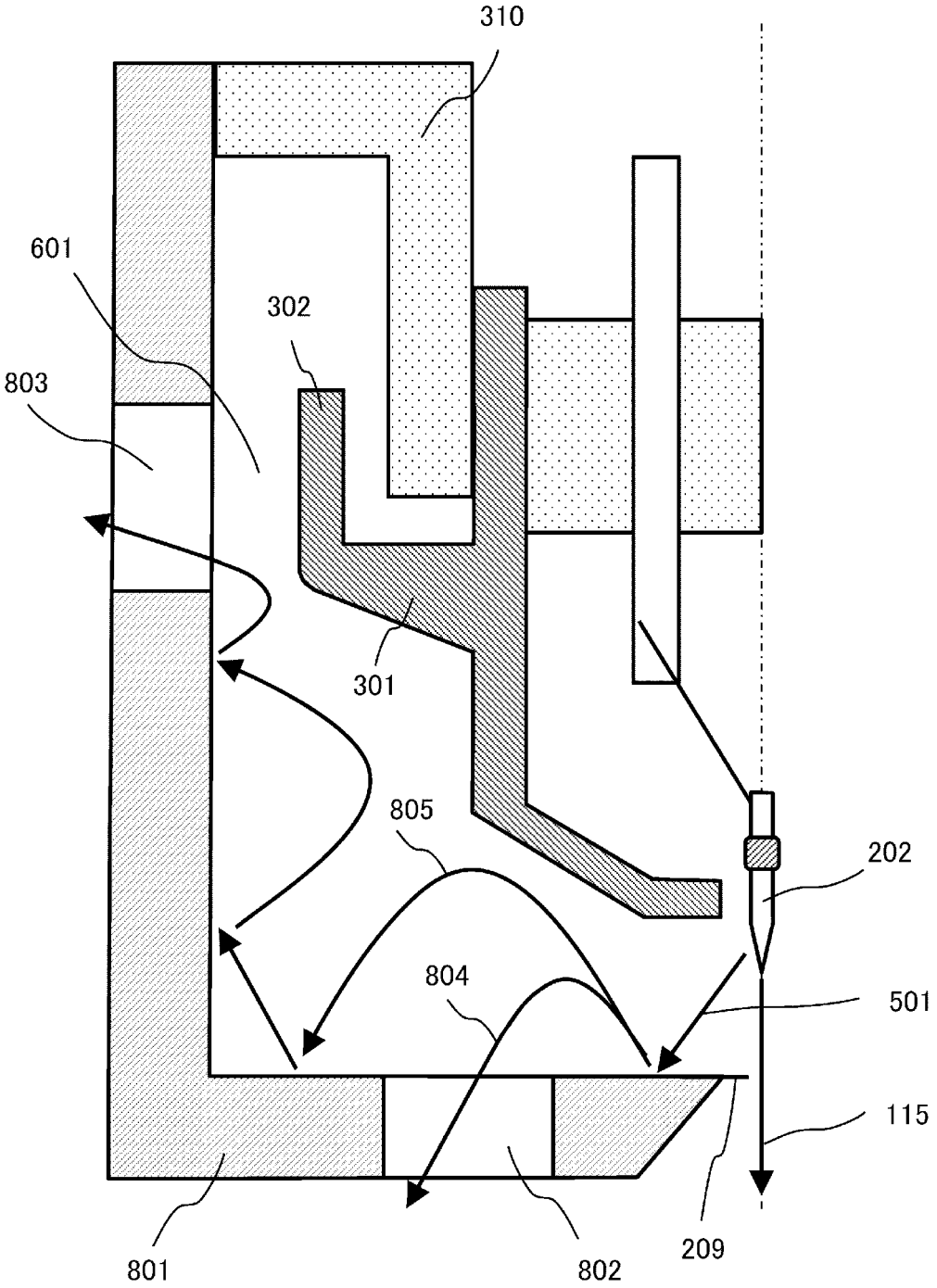

[FIG. 11]
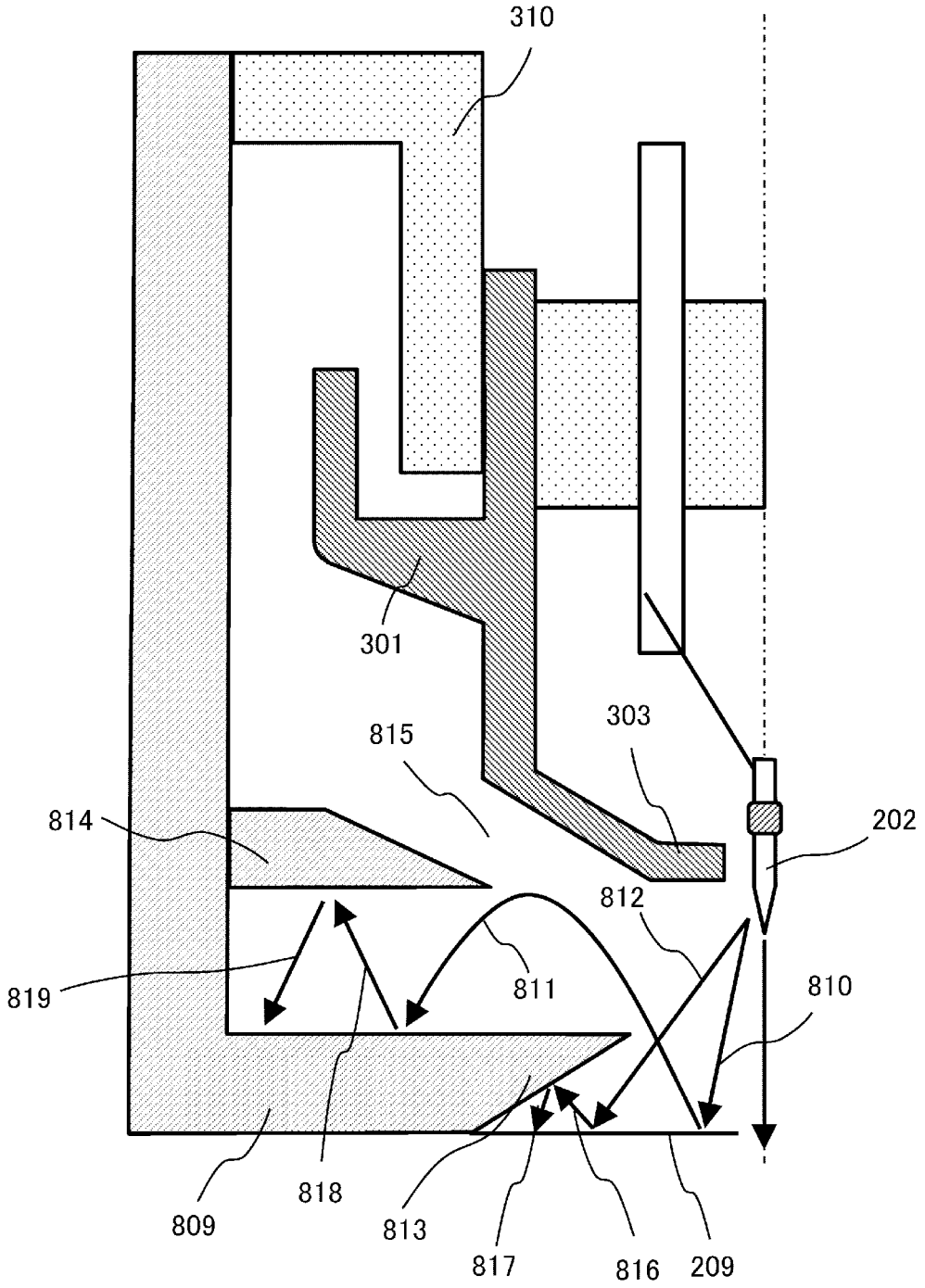

[FIG. 12]
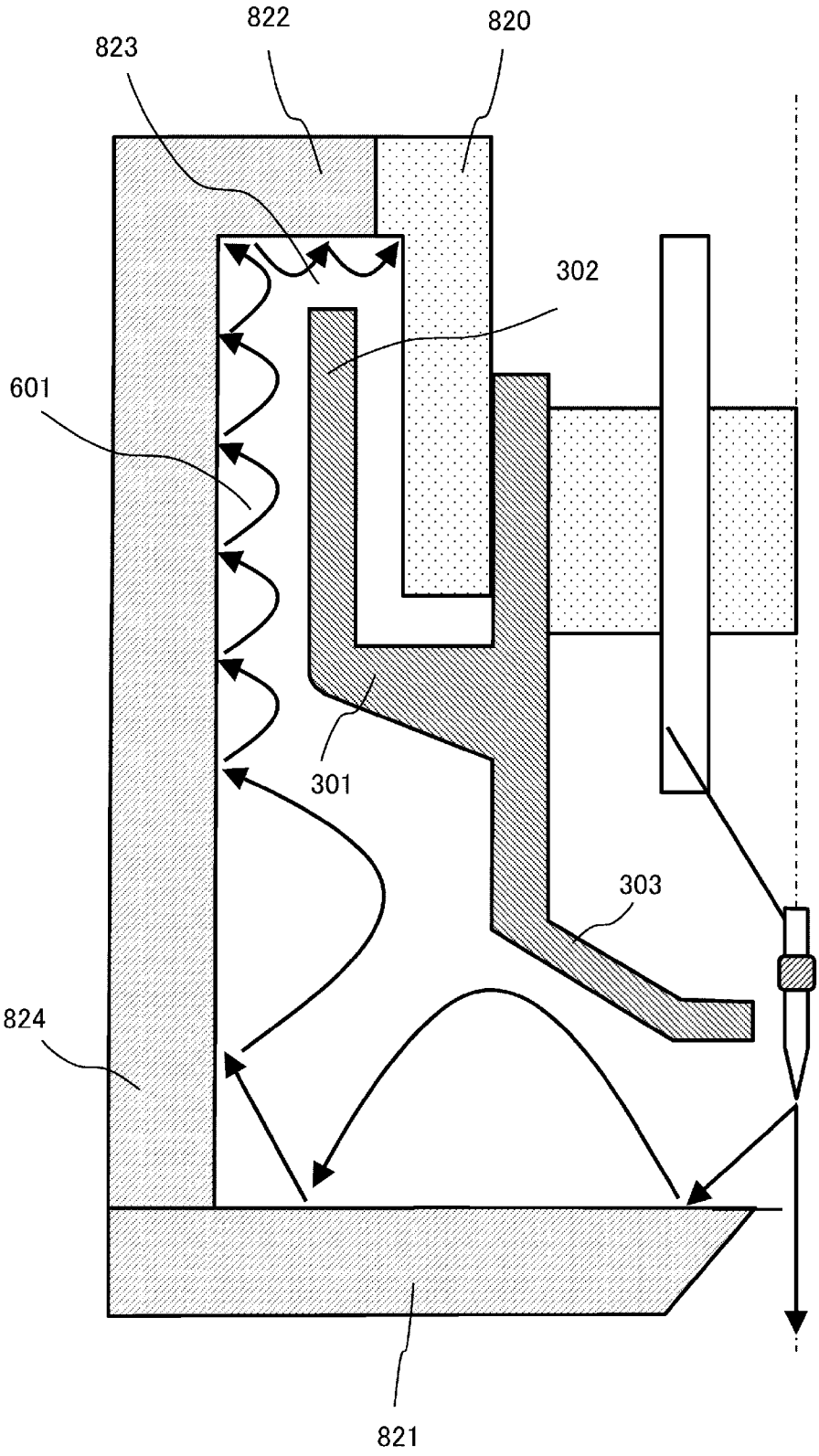

[FIG. 13]
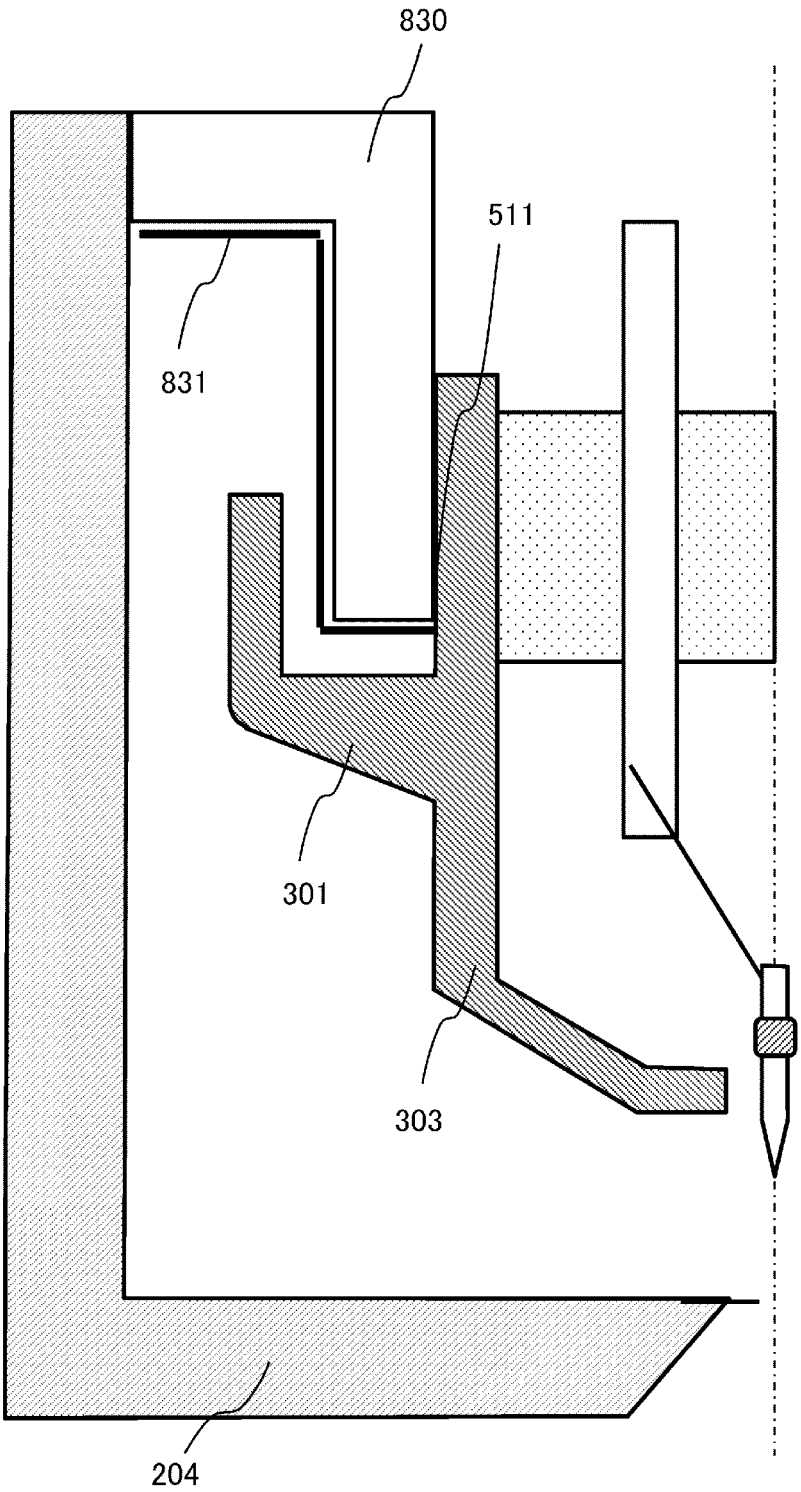

[FIG. 14]
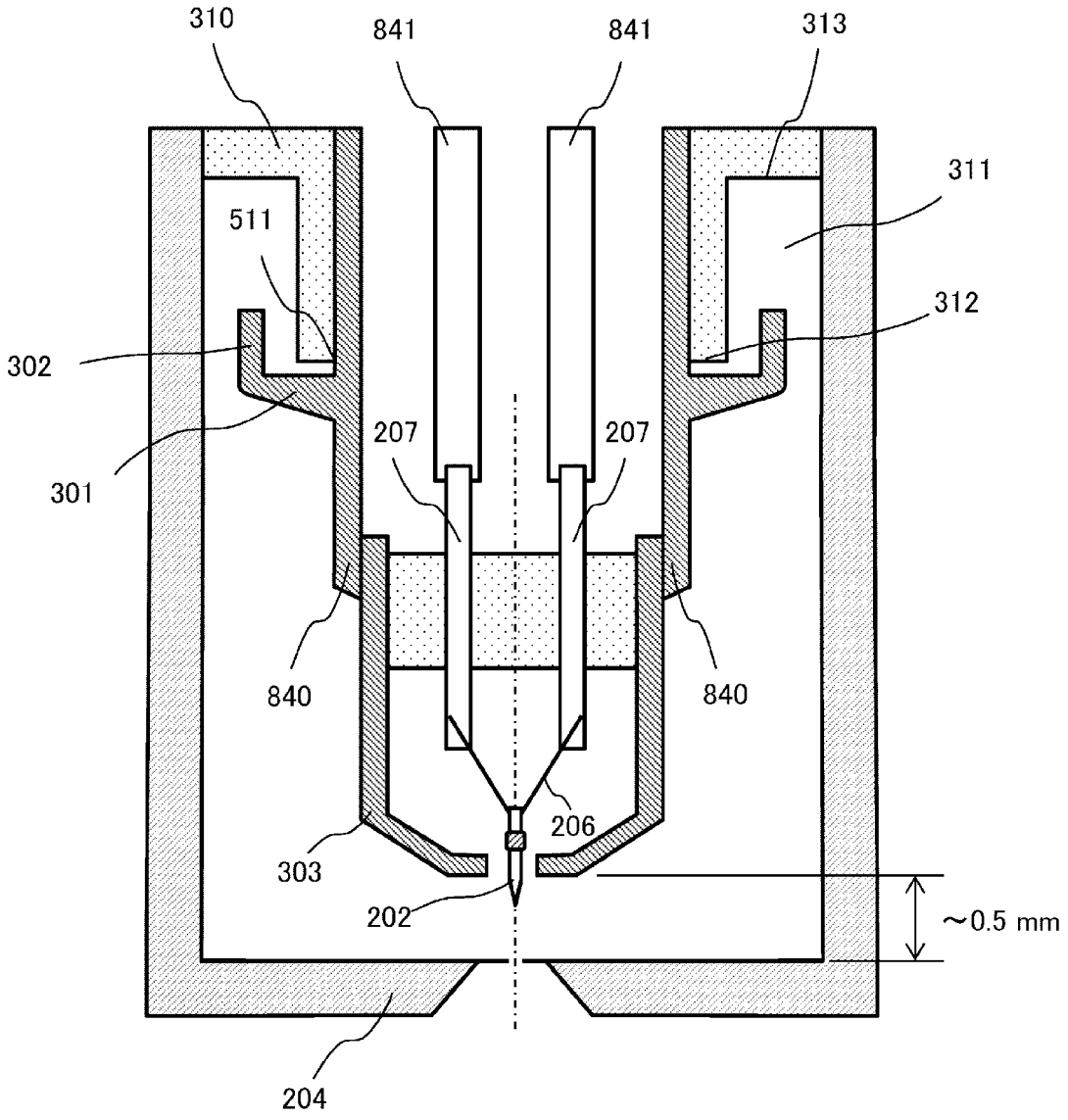

ELECTRON SOURCE AND CHARGED PARTICLE BEAM DEVICE

TECHNICAL FIELD

The present invention relates to an electron source that supplies an electron beam to be emitted to a sample and a charged particle beam device using the electron source.

BACKGROUND ART

A charged particle beam device is a device that generates an observation image of a sample by emitting a charged particle beam such as an electron beam to the sample and detecting transmitted electrons, secondary electrons, back scattered electrons, X-rays, and the like emitted from the sample. The generated image is required to have high spatial resolution and good reproducibility when repeatedly generated. In order to implement these, it is necessary that a brightness of the electron beam to be emitted is high and a current is stable. An example of an electron gun that emits such an electron beam includes a Schottky emission electron gun (hereinafter, referred to as a SE electron gun). PTL 1 describes an example of a structure of the SE electron gun.

In recent years, semiconductor devices and advanced materials have become more sophisticated, and a charged particle beam device that inspects and measures them is required to observe a large number of samples or a large number of points on the same sample in a short time. In addition, the throughput of these observation is required to be increased. This short-time observation can be implemented by emitting a large current from the electron gun and shortening time required to generate an image.

CITATION LIST

Patent Literature

PTL 1: JP-A-8-171879

SUMMARY OF INVENTION

Technical Problem

As a result of researching by inventors, it has been found that when the large current is emitted by the SE electron gun described in PTL 1, a fairly small discharge (hereinafter, referred to as a minute discharge) occurs irregularly many times, and the current of the electron beam fluctuates. An image generated at time of such current fluctuation is an image in which the spatial resolution is deteriorated with no reproducibility. In high spatial resolution observation using an inspection device or a measurement device, the reproducibility of 0.1 nm accuracy is required, and therefore, a change in the spatial resolution due to the minute discharge cannot be allowed, which directly leads to a decrease in a device performance. Further, since a generation timing of the minute discharge and a magnitude of the current fluctuation due to the discharge are random, it is difficult to predict the generation of the minute discharge and correct the deterioration of the spatial resolution on a system. Such a problem at the time of discharging the large current is not described in PTL 1.

An object of the invention is to provide an electron source capable of reducing minute discharge and stably emitting a large current electron beam, and a charged particle beam device using the same.

Solution to Problem

In order to achieve the above object, the invention provides a charged particle beam device including an electron gun including: a tip; a suppressor disposed rearward of a distal end of the tip; an extraction electrode including a bottom surface and a cylindrical portion and enclosing the tip and the suppressor; an insulator holding the suppressor and the extraction electrode; and a conductive metal provided between the suppressor and the cylindrical portion of the extraction electrode. A voltage lower than a voltage of the tip is applied to the conductive metal.

In order to achieve the above object, the invention provides a charged particle beam device including an electron gun including: a tip; a suppressor disposed rearward of a distal end of the tip; a conductive supporting portion holding the suppressor; an extraction electrode including a bottom surface and a cylindrical portion and enclosing the tip and the suppressor; an insulator holding the supporting portion and the extraction electrode; and a conductive metal provided between the supporting portion and the cylindrical portion of the extraction electrode. A voltage lower than a voltage of the tip is applied to the conductive metal.

Further, in order to achieve the above object, the invention provides an electron source including: a tip; a suppressor disposed rearward of a distal end of the tip; an insulator holding a terminal electrically connected to the tip and the suppressor; and a conductive metal disposed on a side surface of the suppressor.

Advantageous Effect

According to the invention, an electron source capable of stably emitting a large current electron beam and a charged particle beam device using the electron source can be provided.

BRIEF DESCRIPTION OF DRAWINGS

FIG. 1 is a schematic diagram of a scanning electron microscope that is an example of a charged particle beam device according to a first embodiment.

FIG. 2 is a schematic diagram showing a configuration around a SE electron gun in the related art.

FIG. 3A is a schematic diagram showing a configuration around a SE electron gun according to the first embodiment.

FIG. 3B is a perspective view showing a configuration example of an electron source of the SE electron gun according to the first embodiment.

FIG. 4 is a diagram showing a current change of an electron beam when minute discharge occurs in the SE electron gun.

FIG. 5 is a schematic diagram showing a mechanism in which the minute discharge occurs in the SE electron gun.

FIG. 6 is a schematic diagram showing a mechanism for preventing the minute discharge in the SE electron gun according to the first embodiment.

FIG. 7 is a schematic diagram showing a configuration around a SE electron gun according to a second embodiment.

FIG. 8 is a schematic diagram showing a configuration around a SE electron gun according to a third embodiment.

FIG. 9 is a schematic diagram showing a configuration around a SE electron gun according to a fourth embodiment.

FIG. 10 is a schematic diagram showing a configuration around a SE electron gun according to a fifth embodiment.

FIG. 11 is a schematic diagram showing a configuration around a SE electron gun according to a sixth embodiment.

FIG. 12 is a schematic diagram showing a configuration around a SE electron gun according to a seventh embodiment.

FIG. 13 is a schematic diagram showing a configuration around a SE electron gun according to an eighth embodiment.

FIG. 14 is a schematic diagram showing a configuration around a SE electron gun according to a ninth embodiment.

DESCRIPTION OF EMBODIMENTS

Hereinafter, various embodiments of an electron source and a charged particle beam device of the invention will be sequentially described with reference to the drawings. An example of the charged particle beam device includes an electron microscope that generates an observation image of a sample by emitting an electron beam on the sample and detecting secondary electrons or back scattered electrons emitted from the sample. Hereinafter, a scanning electron microscope will be described as an example of the charged particle beam device, and the invention is not limited thereto and can be applied to other charged particle beam devices.

First Embodiment

A first embodiment is an embodiment of a scanning electron microscope including an electron gun including: a tip, a suppressor disposed rearward of a distal end of the tip; an extraction electrode including a bottom surface and a cylindrical portion and enclosing the tip and the suppressor; an insulator holding the suppressor and the extraction electrode; and a conductive metal provided between the suppressor and the cylindrical portion of the extraction electrode, in which a voltage lower than a voltage of the tip is applied to the conductive metal.

An overall configuration of the scanning electron microscope according to the present embodiment will be described with reference to FIG. 1. The scanning electron microscope generates an observation image of a sample by emitting an electron beam 115 on a sample 112 and detecting secondary electrons or back scattered electrons emitted from the sample. The observation image is generated by scanning the sample with a focused electron beam and associating a position at which the electron beam is emitted with a detection amount of the secondary electrons or the like.

The scanning electron microscope includes a cylindrical body 125 and a sample chamber 113, and an inside of the cylindrical body 125 is divided into a first vacuum chamber 119, a second vacuum chamber 126, a third vacuum chamber 127, and a fourth vacuum chamber 128 from a top. An opening through which the electron beam 115 passes is defined in a center of each vacuum chamber, and an inside of each vacuum chamber is maintained in a vacuum state by differential pumping. Hereinafter, each vacuum chamber will be described.

The first vacuum chamber 119 is evacuated by an ion pump 120 and a non-evaporable getter (NEG) pump 118, and a pressure is set to ultra-high vacuum of about $10^{-8}$ Pa, more preferably extreme-high vacuum of $10^{-9}$ Pa or less. In particular, the NEG pump 118 has a high pumping speed, which is $10^{-9}$ Pa or less, in the extreme-high vacuum.

A SE electron gun 101 is disposed inside the first vacuum chamber 119. The SE electron gun 101 is held by an insulator 116 and is electrically insulated from the cylindrical body 125. A control electrode 102 is disposed below the SE electron gun 101. The observation image is obtained by emitting the electron beam 115 from the SE electron gun 101 and finally emitting the electron beam 115 on the sample 112. A configuration of the SE electron gun 101 will be described in detail later.

The second vacuum chamber 126 is evacuated by an ion pump 121. An acceleration electrode 103 is disposed in the second vacuum chamber 126. The third vacuum chamber 127 is evacuated by an ion pump 122. A condenser lens 110 is disposed in the third vacuum chamber 127.

The fourth vacuum chamber 128 and the sample chamber 113 are evacuated by a turbo-molecular pump 109. A detector 114 is disposed in the fourth vacuum chamber 128. An objective lens 111 and the sample 112 are disposed in the sample chamber 113.

Hereinafter, an operation of each configuration and a process until the electron beam 115 emitted from the SE electron gun 101 generates the observation image will be described.

A control voltage is applied to the control electrode 102 to form an electrostatic lens between the SE electron gun 101 and the control electrode 102. The electron beam 115 is focused by the electrostatic lens and adjusted to a desired optical magnification.

An acceleration voltage of about 0.5 kV to 60 kV is applied to the acceleration electrode 103 with respect to the SE electron gun 101 to accelerate the electron beam 115. The lower the acceleration voltage is, the less a damage to the sample is, and the higher the acceleration voltage is, the more a spatial resolution is improved. The condenser lens 110 focuses the electron beam 115 and adjusts the current and an aperture angle. A plurality of condenser lenses may be provided, and the condenser lens may be disposed in other vacuum chambers.

Finally, the electron beam 115 is reduced to a minute spot by the objective lens 111, and the sample 112 is irradiated with the electron beam 115 while being scanned. At this time, secondary electrons, back scattered electrons, and X-rays reflecting a surface shape and a material are emitted from the sample. The secondary electrons, the back scattered electrons, and the X-rays are detected by the detector 114 to obtain the observation image of the sample. A plurality of detectors may be provided, and the detector may be disposed the sample chamber 113 and the other vacuum chambers.

A configuration around a SE electron gun 201 in the related art will be described with reference to FIG. 2. The SE electron gun 201 in the related art mainly includes a SE tip 202, a suppressor 203, and an extraction electrode 204.

The SE tip 202 is a single crystal having a tungsten <100> orientation, and a distal end thereof is sharpened to have a radius of curvature of less than 0.5 μm. Zirconium oxide 205 is applied to a middle of the single crystal. The SE tip 202 is welded to a filament 206. Each of both ends of the filament 206 is connected to a corresponding one of terminals 207. The two terminals 207 are held by an insulator 208 and electrically insulated from each other. The two terminals 207 extend in a direction coaxial with the SE tip 202, and are connected to a current source via a feed-through (not shown). The SE tip 202 is heated from 1500 K to 1900 K by constantly passing a current through the terminals 207 and energizing and heating the filament 206. At this temperature, the zirconium oxide 205 diffuses and moves on a surface of the SE tip 202, and covers up to a (100) crystal plane at a center of a distal end of the electron source. The (100) plane is characterized by a reduced work function when covered with zirconium oxide. As a result, thermal electrons are emitted from the heated (100) plane, and the electron beam 115 is obtained. A total quantity of emitted electron beams is called an emission current, and is typically about 50 μA.

The suppressor 203 is a cylindrical metal and covers a portion other than the distal end of the SE tip 202. The cylinder of the suppressor 203 extends parallel to the SE tip 202 in an axial direction, and is held by being fitted to the insulator 208. The suppressor 203 and the terminals 207 are electrically insulated from each other by the insulator 208. The suppressor 203 applies a suppressor voltage of −0.1 kV to −0.9 kV to the SE tip 202. The SE tip 202 is characterized by emitting the thermal electrons from a side surface thereof. However, by applying such a negative voltage to the suppressor 203, unnecessary thermal electrons emitted from the side surface are prevented.

The distal end of the SE tip 202 typically protrudes from the suppressor 203 by about 0.25 mm. In this way, by performing precise positioning of 1 mm or less and protruding by only a slight distance, only the distal end of the SE tip 202 contributes to the emission of the electron beam, and a quantity of unnecessary electrons emitted from the side surface is reduced as much as possible. Further, when a protrusion length is about 0.25 mm, there is an advantage that a sufficient electric field can be applied to the distal end of the electron source by a configuration of an extraction voltage to be described later.

The extraction electrode 204 is a cup-shaped metal cylinder in which a bottom surface and a cylinder are integrally formed, and the bottom surface of the extraction electrode 204 faces the SE tip 202. The extraction electrode 204 is held by being fitted to an insulator 210, and is electrically insulated from the suppressor 203. The extraction electrode 204 applies an extraction voltage of about +2 kV to the SE tip 202. Since the distal end of the SE tip 202 is sharpened, a high electric field is concentrated on the distal end. As the applied electric field increases, an effective work function of the surface decreases due to a Schottky effect, and more electron beams can be emitted.

A distance between the SE tip 202 and the bottom surface of the extraction electrode 204 is typically about 0.5 mm. By assembling at such a short distance, a sufficiently high electric field can be applied to the distal end of the electron source even at a low extraction voltage. A aperture 209 is provided on the bottom surface of the extraction electrode 204, and electrons that have passed through the aperture 209 are finally used to generate the image. A molybdenum thin plate is used for the aperture 209, and a diameter of an opening of the aperture 209 is typically about 0.1 mm to 0.5 mm. By making the opening small, unnecessary electrons are prevented from passing through the aperture, and the observation image is prevented from deteriorating.

The SE tip 202 is positioned and welded on a center axis of the insulator 208 using a high-precision jig. An outer periphery of the insulator 208 and an inner periphery of the suppressor 203, an outer periphery of the suppressor 203 and an inner periphery of the insulator 210, and an outer periphery of the insulator 210 and an inner periphery of the extraction electrode 204 are assembled by fitting in an order of 10 μm. Therefore, the SE tip 202, the suppressor 203, and the extraction electrode 204 have a highly accurate coaxial structure, and the electrodes can be precisely positioned.

Since the SE tip 202 and the suppressor 203 have the coaxial structure, a potential distribution generated by the suppressor 203 in the vicinity of the SE tip 202 is uniform. As a result, the unnecessary electrons to be emitted from the side surface of the SE tip 202 can be uniformly reduced in all directions. In addition, electrons emitted from the SE tip 202 are not bent at a non-uniform potential in a space, and the electron beam can be emitted on an axis.

Since the SE tip 202 and the extraction electrode 204 have the coaxial structure, the aperture 209 can also be coaxially disposed. As a result, there is no possibility that the electron beam cannot be obtained due to displacement of the aperture 209, which hinders the passage of emitted electrons. Further, an electric field distribution applied to the distal end of the SE tip 202 by the aperture 209 is uniform, and the electron beam can be emitted on the axis.

In this way, the SE electron gun needs to be assembled with high accuracy with a small dimension of 1 mm or less in order to efficiently emit the electron beam from the distal end of the electron source, reduce unnecessary electrons emitted from the side surface of the electron source, and implement a uniform potential distribution in the electron gun space. Therefore, the SE electron gun is characterized by having a very narrow space and maintaining a voltage difference on an order of kV therein.

A configuration around the SE electron gun 101 according to the present embodiment and a configuration of the electron source thereof will be described with reference to FIGS. 3A and 3B. The electron gun of the present embodiment includes the electron source including the SE tip 202, the filament 206, the insulator 208, and an additional suppressor 303 having a shield electrode 301 formed of a conductive metal, and is characterized in that an insulator 310 having a step is used and a gap 311 is defined between a lower surface of the insulator 310 and an inner circumferential surface of the cylinder of the extraction electrode 204. The electron source of the present embodiment is an electron source including the SE tip 202, the suppressor 303 disposed rearward of the distal end of the tip, an insulator 208 holding the terminals 207 electrically connected to the tip and the suppressor, and the shield electrode 301 disposed on the side surface of the suppressor. The shield electrode 301 is formed of a conductive metal, to which a voltage lower than a voltage of the tip is applied. The same reference numerals denote the same components as those described above, and the description thereof will be omitted.

As shown in FIG. 3A, a step is provided on a bottom side of the insulator 310, and a surface disposed below (in a travelling direction of the electron beam 115) is referred to as a lower surface 312, and a surface above is referred to as an upper surface 313 for convenience. The lower surface 312 is disposed on a shield electrode 301 side, and the upper surface 313 is provided on an extraction electrode 204 side. Accordingly, the gap 311 is defined between the lower surface 312 of the insulator 310 and the inner circumferential surface of the extraction electrode 204.

As shown in FIGS. 3A and 3B, the shield electrode 301 integrally formed of the conductive metal is provided on the side surface of the suppressor 303. The cylindrical portion on the side surface of the suppressor 303 extends in the axial direction of the SE tip 202 and is held to the insulator 310 by fitting. The shield electrode 301 is provided on the side surface of the cylindrical portion of the suppressor 303 and protrudes laterally. In other words, the shield electrode 301 has a structure extending in a direction perpendicular to the axial direction of the SE tip 202. In other words, the shield electrode 301 is disposed between the suppressor 303 and the cylindrical portion of the extraction electrode 204. A voltage difference between the shield electrode 301 and the extraction electrode 204 is maintained by vacuum between the shield electrode 301 and the extraction electrode 204, and is electrically insulated.

The shield electrode 301 further includes a cylindrical portion 302 extending toward an insulator 310 side. An upper end of the cylindrical portion 302 extends to the gap 311. The cylindrical portion 302 of the shield electrode 301 has the same axis as the cylinder of the extraction electrode 204, and extends in a parallel direction. Typically, since the cylinder of the extraction electrode 204 extends in the axial direction of the SE tip 202, the cylindrical portion 302 also extends in the axial direction of the SE tip 202. As a result, the lower surface 312 of the insulator 310 is covered with the shield electrode 301 and the cylindrical portion 302, and is not affected by the extraction electrode 204. The shield electrode 301 including the cylindrical portion 302 is not in contact with the insulator 310, which prevents an unnecessary electric field from concentrating on a surface of the shield electrode 301. A voltage difference between the suppressor voltage and the extraction voltage is applied to an outer peripheral side surface of the shield electrode 301. Therefore, the side surface of the shield electrode is formed of a curved surface or a flat surface to prevent the unnecessary electric field from concentrating. A function of preventing the minute discharge by the present configuration will be described later. The insulator 208 and the insulator 310 may be formed of other electrical insulating materials such as glass. In the SE electron gun 101 of the present embodiment, a distal end radius of curvature of the SE tip 202 is 0.5 μm or more, more preferably 1.0 μm or more. When a large current is emitted, Coulomb interaction between electrons works, and when a large current is emitted with a radius of curvature in the related art, a brightness of the electron beam decreases. By increasing the radius of curvature of the distal end of the SE electron source, an emission area of the electron beam increases, and a current density on the surface decreases. As a result, an effect of the Coulomb interaction is weakened, and the decrease in the brightness at the time of the large current is prevented.

When the distal end radius of curvature of 0.5 μm is used, the emission current is set to 300 μA or more, so that a high brightness that cannot be obtained with the radius of curvature in the related art can be obtained. In order to obtain this emission current, the extraction voltage is typically 3 kV or more. When the distal end radius of curvature of 1 μm is used, the emission current is set to 600 μA or more, so that the brightness higher than that in the related art can be obtained. In order to obtain this emission current, the extraction voltage is typically set to 5 kV or more.

When the electrons are emitted on a metal material such as the extraction electrode 204 or the aperture 209, electron impact desorption gas is emitted. An emission amount of the electron impact desorption gas increases in proportion to an amount of an emitted current and the extraction voltage to be applied. Therefore, when the emission current of 300 μA or 500 μA or more, which is a large current, is emitted from the SE tip 202 at a high extraction voltage, the electron impact desorption gas that is one or more orders of magnitude larger than that in the related art is generated, and the pressure of the vacuum chamber 119 shown in FIG. 1 is deteriorated. When the pressure is on the order of $10^{-7}$ Pa, the surface of the SE tip 202 is damaged, the shape of the SE tip 202 collapses, and stability of the current may be impaired. However, in the electron microscope of the present embodiment, the vacuum chamber 119 is evacuated by the NEG pump 118 and the ion pump 120 having a high pumping speed. Therefore, even when the large current is emitted, the deterioration of the pressure is reduced, and the pressure in the vacuum chamber 119 can be maintained at $10^{-8}$ Pa or less. Therefore, there is an effect that the surface of the SE tip 202 is not damaged and a stable electron beam can be obtained even with the large current.

Hereinafter, an operation of the SE electron gun 101 according to the present embodiment for preventing the minute discharge will be described with reference to FIGS. 4 to 6.

With reference to FIG. 4, a current change of the electron beam when the minute discharge occurs will be described. The minute discharge occurs instantaneously and ends in a short time of 1 second or less, as is clear from the figure. At this time, the current amount of the electron beam instantaneously decreases, and then returns to an original current amount. The pressure in the first vacuum chamber may rise instantaneously at the same time as the minute discharge, and the pressure in the first vacuum chamber also returns to an original pressure within several seconds.

The discharge that is a problem in the electron gun is a type of problem generally called flashover or breakdown. Once the discharge occurs, it causes melting of the electron source, breakage of a high voltage power supply, dielectric breakdown of the insulator, and the like, and is a large discharge that cannot obtain the electron beam again unless the electron source, the power supply, and the insulator are exchanged. On the other hand, the minute discharge is characterized in that the current temporarily decreases and the electron beam is continuously obtained thereafter, and is a relatively mild discharge. The discharge in the related art occurs, for example, when a high extraction voltage of about +10 kV is applied to the extraction electrode. On the other hand, the minute discharge does not occur even when the similar high extraction voltage is applied, but occurs only when electron beam emission of the large current is performed in addition to the application of the extraction voltage, and a frequency of occurrence increases as the current increases. Further, as the current increases, a threshold of the extraction voltage at which the minute discharge occurs decreases. The minute discharge has a generation mechanism different from that of the discharge in the related art, which can be said to be a different phenomenon. Hereinafter, in order to distinguish the discharge from the minute discharge, the discharge that has been considered as a problem in the related art is referred to as the large discharge.

With reference to FIG. 5, a mechanism in which the minute discharge occurs in the SE electron gun 201 in the related art shown in FIG. 2 will be described. Since the electron gun has an axisymmetric structure, only one side surface is shown. Further, a potential distribution 510 in a space defined by voltages applied to the tip 202, the suppressor 203, and the extraction electrode 204 is schematically indicated by broken lines.

The distal end of the SE tip 202 protrudes from the suppressor 203, and a side beam 501 is emitted from a (100) equivalent crystal plane present on the side surface of the SE tip 202. The side beam 501 is emitted in an oblique direction and collides with the extraction electrode 204. Further, a part of the electron beam 115 emitted from the (100) plane at the center of the distal end of the electron source also collides with the aperture 209. An amount of the current colliding with the extraction electrode 204 or the aperture 209 is 90% or more of the emission current. The SE electron gun is characterized in that most of the current emitted from the electron source is emitted to a narrow space in the gun.

When the electrons collide with the metal material such as the extraction electrode 204 and the aperture 209, a part of the electrons are emitted to a vacuum side as back scattered electrons. An emission angle of the back scattered electrons has a spread, and generally has a distribution based on a cosine law with a specular reflection component as a peak. Further, energy of the back scattered electrons also has a distribution, and has electrons in which the energy at the time of emission is preserved by elastic scattering and electrons in which the energy is lost by inelastic scattering. Therefore, each of the back scattered electrons has a different trajectory. Here, as a typical example, an outline of the trajectory will be described using back scattered electrons 502.

The back scattered electrons 502 emitted from the extraction electrode 204 travel in a direction of the suppressor 203, but energy of the back scattered electrons 502 is the same as the extraction voltage at a maximum and cannot reach the suppressor 203. Therefore, the back scattered electrons 502 are pushed back by a repulsive force acting in a vertical direction of the potential distribution, and collides with the extraction electrode 502 again. A part of the back scattered electrons 502 is emitted as back scattered electrons 503 and collides with a cylindrical inner surface of the extraction electrode 204. A part of the back scattered electrons 503 is emitted again as back scattered electrons 504, is pushed back to the potential distribution of the suppressor 203, and collides with the extraction electrode 204 again. A part of the back scattered electron 504 becomes back scattered electrons 505, and finally collides with the insulator 210.

A secondary electron emission rate of the insulator 210 is greater than 1, and when one electron collides with the insulator 210, more than one secondary electron is emitted. Energy of emitted secondary electrons 506 is as small as several volts, and reaches and is absorbed by the extraction electrode 204 by the repulsive force of the potential distribution. As a result, the number of electrons on a surface 507 of the insulator 210 with which the back scattered electrons 505 collide decreases, and the surface 507 is positively charged.

A potential difference higher than that before the charging is formed on a creepage between a contact point 511 between the suppressor 203 and the insulator 210 and the positively charged surface 507, and a higher electric field is applied to the contact point 511 as a distance between the contact point 511 and the surface 507 is shorter. As a result, electric field emission occurs at the contact point 511, and a large amount of electrons are emitted. While receiving the repulsive force of the potential distribution, the electrons move in the creepage or a space of the insulator 210 and reach the extraction electrode 204. The minute discharge is generated by current transfer between the electrodes, and a voltage difference between the electrodes is changed, so that the current of the electron beam fluctuates.

In summary, when the large current is emitted by the SE electron gun, a large amount of electrons are supplied into the narrow space in the gun. These electrons are pushed back to the extraction electrode by the potential distribution formed between the suppressor 203 and the extraction electrode 204, and the back scattered electrons are repeatedly generated. The back scattered electrons finally reach the insulator 210, and the surface of the insulator 210 is positively charged locally. As the voltage difference between the positively charged surface 507 and the suppressor 203 increases, and electric field concentration occurs, so that the minute discharge occurs.

A mechanism by which the SE electron gun 101 of the present embodiment prevents the minute discharge will be described with reference to FIG. 6. Similar to the SE electron gun in the related art, in the SE electron gun 101 according to the present embodiment, the side beam 501 emitted from the SE tip 202 collides with the extraction electrode 204 to emit the back scattered electrons 502. The back scattered electrons 502 are pushed back by the repulsive force by the potential distribution generated between the suppressor 303 and the extraction electrode 204, and collide with the extraction electrode 204 again. After that, the back scattered electrons 502 repeat emission from the extraction electrode and the collision.

Here, in the SE electron gun 101 according to the present embodiment, since the shield electrode 301 is provided in the suppressor 303, a negative potential distribution generated by the suppressor voltage is widened, and the back scattered electrons are less likely to reach the insulator 310. In particular, since the lower surface 312 of the insulator 310 is surrounded by the shield electrode 301 and the cylindrical portion 302 thereof, the back scattered electrons cannot collide with the lower surface 312. The back scattered electrons finally repeatedly collide with the upper surface 313 of the insulator 310 more than that in the related art, and then positively charge a surface 517 of the insulator 310. The insulator 310 has a step on the bottom side, and the upper surface 313 and the lower surface 312 are separated from each other. Therefore, a creepage distance between the contact point 511 between the insulator 310 and the suppressor 303 and the positively charged surface 517 is sufficiently long, and a high electric field is not applied to the contact point 511. As a result, the electric field emission does not occur and the minute discharge is prevented.

As another effect of the present embodiment, a narrow path 601 may be defined between the cylindrical portion 302 and the inner circumferential surface of the extraction electrode 204 by causing the cylindrical portion 302 of the shield electrode 301 to have the same axis as the cylinder of the extraction electrode 204 and extending the cylindrical portion 302 parallel to the extraction electrode 204 by a certain distance. In the narrow path 601, the potential distribution becomes narrow, and a flight distance of the back scattered electrons becomes short, so that a large number of re-collisions occur. Every time a collision occurs, the number of back scattered electrons decreases by several tens percent. As the number of times of re-collision increases, the absolute number of the back scattered electrons reaching the insulator 310 decreases, and a charging amount decreases, thereby preventing the minute discharge.

As another effect, since the contact point 511 is surrounded by the shield electrode 301, the potential distribution inside the shield electrode 301 is uniform, and the electric field is small. For example, even when the electrons are emitted from the contact point 511, a force applied to the electrons is small, a chance that the electrons reach the extraction electrode 204 is small, and the minute discharge is less likely to occur.

As another effect, even when a creepage distance of the bottom side of the insulator 310 is increased, the chance that the electrons move in the creepage and reach the extraction electrode 204 is reduced, and the minute discharge is reduced. In addition, the large discharge is less likely to occur in association with the extension of the creepage distance. In the SE electron gun according to the present embodiment, the SE tip 202 having a distal end radius of curvature of 0.5 μm or 1.0 μm or more is used, and the extraction voltage of 3 kV or 5 kV or more is applied to the extraction electrode 204. Further, when a SE electron source having a larger distal end curvature is used, the extraction voltage increases to 10 kV or more. Even in this case, by extending the creepage distance of the insulator 310, the electric field in a creepage direction is reduced, and a risk of the large discharge is also reduced.

As another effect, since the suppressor 303 and the shield electrode 301 are integrally formed, a simple structure can be maintained without increasing the number of components. This has an advantage of cost reduction. Further, similar to the SE electron gun in the related art, the insulator 208, the suppressor 303, the insulator 310, and the extraction electrode 204 can be assembled by fitting, and the coaxial structure and the electrode can be positioned with high accuracy. As a result, also in the electron gun 101 according to the present embodiment, efficient electron beam emission from the electron source, reduction of the unnecessary electron emission from the side surface of the electron source, and uniform potential distribution in the electron gun space can be implemented.

Ions are generated from the metal irradiated with the electron beam by electron impact desorption. Even by the collision of the ions, the insulator 210 is positively charged, and the minute discharge may occur by the same mechanism. However, with the SE electron gun 101 according to the present embodiment, the minute discharge caused by the ions can be prevented.

Second Embodiment

The first embodiment discloses that the shield electrode 301 formed integrally with the suppressor 303 and the insulator 310 having a step are used, and a collision position of back scattered electrons on a surface of the insulator 310 is separated from the suppressor 303, thereby preventing minute discharge. A second embodiment describes a configuration of a SE electron gun in which a suppressor and a shield electrode have different structures. A configuration other than the shield electrode is the same as that of the first embodiment, and thus description thereof will be omitted.

The SE electron gun of the second embodiment will be described with reference to FIG. 7. A shield electrode 701 has a structure different from that of the suppressor 203 and is formed of a conductive metal. An inner circumferential surface of the shield electrode 701 and an outer circumferential surface of the suppressor 203 are assembled and held by fitting. Further, an outer circumferential surface of the shield electrode 701 and an inner circumferential surface of the insulator 310 are assembled by fitting. As a result, the tip 202, the suppressor 203, the shield electrode 701, and the extraction electrode 204 have a coaxial structure and can be precisely positioned. When the shield electrode 701 and the suppressor 203 come into contact with each other, the shield electrode 701 and the suppressor 203 have the same potential, and a suppressor voltage is applied.

In the SE electron gun according to the present embodiment, similar to the SE electron gun 101 of the first embodiment, an end surface of a cylindrical portion 722 of the shield electrode 701 reaches the gap 311 provided in the insulator 310 having a step. Therefore, an operation described with reference to FIG. 6 works, and the minute discharge can be prevented.

In the electron gun according to the present embodiment, since the number of components is increased, the number of fitting portions is increased, and there is a possibility that an axial accuracy is deteriorated and a cost is increased. However, when the shield electrode 701 has a structure different from that of the suppressor 203, the suppressor 203 used in the SE electron gun 201 in the related art can be diverted. By using a normalized suppressor structure, there are advantages that a manufacturing cost of the suppressor is reduced and a SE electron source with a commercially available suppressor can be used as it is.

Third Embodiment

The second embodiment describes a configuration in which a suppressor and a shield electrode have different structures. A third embodiment describes a configuration in which a position at which the insulator 310 is fitted to the suppressor is changed and a size of a shield electrode is reduced. A configuration other than the shield electrode is the same as that of the first embodiment, and thus description thereof will be omitted.

A SE electron gun of the third embodiment will be described with reference to FIG. 8. A suppressor 702 of the present embodiment has a shield electrode 703 at an upper end of a side surface thereof, and the suppressor 702 and the shield electrode 703 are integrally formed as in the first embodiment. An outer circumferential surface of a cylindrical portion having the lower surface 312 of the insulator 310 and an inner circumferential surface of the suppressor 702 are held and assembled by fitting. As a result, each electrode has a coaxial structure and is precisely positioned.

In the SE electron gun according to the present embodiment, a position of the contact point 511 between the suppressor 702 serving as a starting point of electric field emission and the insulator 310 is changed. However, similar to the SE electron gun 101 of the first embodiment, an end surface of a cylindrical portion 723 of the shield electrode 703 reaches the gap 311 provided in the insulator 310 having a step. As a result, the contact point 511 is covered with a potential of the shield electrode 703, and minute discharge is prevented by an operation described with reference to FIG. 6.

By changing a fitting position between the suppressor 702 and the insulator 310 as in the present embodiment, a size of the shield electrode 703 can be reduced. As a result, there is an advantage that a diameter of the extraction electrode 204 can be reduced and the SE electron gun can be downsized. In addition, since a shape of the shield electrode 703 can be relatively simplified, there is an advantage that the suppressor 702 having an integrated configuration can be easily manufactured and a cost can be reduced.

Fourth Embodiment

The third embodiment describes a configuration in which a fitting position of the insulator 310 is changed and a size of a shield electrode is reduced. A fourth embodiment describes an embodiment of an electron source that can be mounted on the SE electron gun 201 in the related art of FIG. 2 by changing a structure of the shield electrode and in which a suppressor 704 and a shield electrode 705 are integrated. A configuration other than the shield electrode 705 is the same as that of the first embodiment, and thus description thereof will be omitted.

A SE electron gun according to the present embodiment will be described with reference to FIG. 9. The suppressor 704 according to the present embodiment includes the shield electrode 705 integrated with the suppressor 704 on a side surface of the suppressor 704. Unlike the shield electrode 301 according to the first embodiment, the shield electrode 705 does not have a cylindrical portion. The shield electrode 705 protrudes in an outer circumferential direction and covers the contact point 511 between the suppressor 704 and the insulator 210 from only a lower direction. Therefore, a positively charged portion of a surface of the insulator 210 is separated from the contact point 511 by an amount corresponding to the protrusion of the shield electrode 705. As a result, a frequency of minute discharge can be reduced as compared to the SE electron gun 201 in the related art.

Since the SE electron gun according to the present embodiment does not include the insulator 310 having a step described in the first embodiment, a creepage distance cannot be sufficiently extended. In addition, since the contact point 511 is not covered with the cylindrical portion 302 of the shield electrode, an electric field is easily applied to the contact point 511. Therefore, as compared to the first embodiment, an effect of preventing the minute discharge is limited, and the frequency is reduced. However, simply by changing only the suppressor 704 according to the present embodiment, the suppressor 704 can be mounted on the SE electron gun 201 in the related art, and there is an advantage that the frequency of the minute discharge can be reduced while reducing a development cost.

Fifth Embodiment

In the fourth embodiment, a structure of a shield electrode is changed, and the shield electrode can be mounted on a SE electron gun in the related art. A fifth embodiment describes a configuration in which an opening is provided in an extraction electrode to reduce the absolute number of back scattered electrons reaching an insulator, thereby enhancing an effect of preventing minute discharge. In the present embodiment, when an opening of the aperture 209 is provided, at least two openings are provided in the extraction electrode. A configuration other than the extraction electrode is the same as that of the first embodiment, and thus description thereof will be omitted.

A SE electron gun of the fifth embodiment will be described with reference to FIG. 10. An extraction electrode 801 according to the present embodiment has an opening 802 different from the opening of the aperture 209 on a bottom surface thereof. In addition, an opening 803 is provided in a cylindrical surface of the extraction electrode 801 at a position facing the cylindrical portion 302 of the shield electrode 301. When the extraction electrode 801 is irradiated with the side beam 501 emitted from the tip 202, back scattered electrons are emitted. Among the back scattered electrons, some of back scattered electrons 804 having low energy pass through the opening 802 in the bottom surface and pass to an outside of the SE electron gun. As a result, the absolute number of the back scattered electrons finally reaching the insulator 310 is reduced.

On the other hand, even for back scattered electrons 805 having high energy and flying over the opening 802 in the bottom surface, many of the back scattered electrons 805 pass through the opening 803 of a cylindrical surface to the outside of the SE electron gun after re-collision is repeated. In the narrow path 601 between the extraction electrode 801 and the cylindrical portion 302, potential distribution is narrow, and a large number of the back scattered electrons re-collide. By providing the opening 803 at this position, many back scattered electrons move to the outside of the SE electron gun, and the absolute number of the back scattered electrons finally reaching the insulator 310 can be effectively reduced. With the opening 802 and the opening 803 of the extraction electrode 801 described above, a charging amount of the insulator 310 is reduced, and the minute discharge can be further prevented.

By increasing a diameter of the aperture 209 so that the side beam 501 is emitted on the aperture 209, and providing an opening at an emission position of the side beam 501 on the aperture 209, the minute discharge can also be prevented by the same action as described above.

Sixth Embodiment

The fifth embodiment describes a configuration in which an opening is provided in an extraction electrode to reduce the absolute number of back scattered electrons reaching an insulator, thereby enhancing an effect of preventing minute discharge. A sixth embodiment describes a configuration in which a protrusion is provided on an inner side of the extraction electrode to reduce the absolute number of the back scattered electrons reaching the insulator, thereby enhancing the effect of preventing the minute discharge. A configuration other than the extraction electrode is the same as that of the first embodiment, and thus description thereof will be omitted.

A SE electron gun of the sixth embodiment will be described with reference to FIG. 11. An extraction electrode 809 according to the present embodiment has a protrusion 813 on a bottom surface. In addition, a protrusion 814 is provided on a cylindrical surface. The protrusion 813 on the bottom surface is formed integrally with the extraction electrode 809, and the aperture 209 is disposed below the protrusion 813. Further, the protrusion 813 has a taper, and a diameter of an opening of the protrusion 813 is larger on a aperture 209 side than on a SE tip 202 side. An extraction voltage is applied to the protrusion 813. An upper surface of the protrusion 813 facing the suppressor 303 is a flat surface in order to prevent unnecessary electric field concentration.

The protrusion 814 on the cylindrical surface is formed integrally with the extraction electrode 809, and the extraction voltage is applied to the protrusion 814. An end surface of the protrusion 814 on a suppressor 303 side has a taper, and a diameter of an opening is larger in a lower surface than in an upper surface. A surface of the end surface of the protrusion 814 facing the suppressor 303 is a flat surface to prevent the unnecessary electric field concentration.

Among side beams emitted from the SE tip 202, a side beam 812 having a large emission angle collides with the aperture 209 and then emits back scattered electrons 816. Since the back scattered electrons 816 are emitted with a peak in a mirror surface direction, most of the back scattered electrons 816 collide with a lower surface of the taper of the protrusion 813. From this lower surface, emitted back scattered electrons 817 collide with the aperture 209. In this way, by providing the protrusion 813, the side beam 812 having the large emission angle repeats the re-collision of a large number of the back scattered electrons at a bag portion generated between the taper of the protrusion 813 and the aperture 209, thereby reducing the number of back scattered electrons. As a result, the electrons are impossible to reach the insulator 310.

A side beam 810 having a small emission angle emitted from the SE tip 202 collides with the aperture 209 and then emits back scattered electrons 811. The back scattered electrons 811 pass through the opening of the protrusion 813 and collide with the extraction electrode 809 to emit back scattered electrons 818. The back scattered electrons 818 collide with the lower surface of the protrusion 814 and emit back scattered electrons 819. In this way, by providing the protrusion 814, the side beam 810 having the small emission angle repeats the re-collision of a large number of back scattered electrons at the bag portion generated between the lower surface of the protrusion 814 and the extraction electrode 809, thereby reducing the number of back scattered electrons. As a result, the electrons are impossible to reach the insulator 310.

The protrusion 813 and the protrusion 814 of the extraction electrode 809 reduce the absolute number of the back scattered electrons reaching the insulator 310 and reduce a charging amount of the insulator 310. As a result, the minute discharge can be further prevented.

As another effect, a narrow path 815 is defined between the protrusion 814 and the suppressor 303. The narrow path 815 has a small solid angle at which the back scattered electrons can pass, and the back scattered electrons are difficult to pass the narrow path 815. In addition, a potential distribution is narrow, forcing the back scattered electrons to collide with the protrusion 814 in large numbers. As a result, the number of the back scattered electrons reaching the insulator 310 is effectively reduced.

Seventh Embodiment

The sixth embodiment describes a configuration in which a protrusion is provided on inner side of an extraction electrode to reduce the absolute number of back scattered electrons reaching an insulator, thereby enhancing an effect of preventing minute discharge. A seventh embodiment describes a configuration in which an inner diameter of a contact portion between the extraction electrode and the insulator is made smaller than an inner diameter of a cylindrical portion of the extraction electrode. In other words, a neck portion is provided in the extraction electrode, the neck portion and the insulator are held by fitting, and the absolute number of the back scattered electrons is reduced, thereby enhancing the effect of preventing the minute discharge. A configuration other than the extraction electrode is the same as that of the first embodiment, and thus description thereof will be omitted.

A SE electron gun of the seventh embodiment will be described with reference to FIG. 12. The extraction electrode of the present embodiment is divided into an extraction electrode bottom portion 821 and an extraction electrode cylindrical portion 824 for assembly. Further, a neck portion 822 is provided at an upper portion of the extraction electrode cylindrical portion 824. The neck portion 822 and an insulator 820 are held by fitting. Further, the insulator 820 and the suppressor 303 are held by fitting. Further, a length of the cylindrical portion 302 of the suppressor 303 is extended to be the vicinity of the neck portion 822.

Since the cylindrical portion 302 is extended, a distance of the narrow path 601 defined between the cylindrical portion 302 of the shield electrode 301 and the extraction electrode cylindrical portion 824 is extended. In addition, a narrow path 823 is added between the neck portion 822 and the cylindrical portion 302. As the distances between the narrow paths increase, the number of times back scattered electrons collide with the extraction electrode bottom portion 821 increases, and the number of the back scattered electrons reaching the insulator 820 decreases. As a result, a charging amount of the insulator 820 is reduced, and the minute discharge is prevented.

Eighth Embodiment

The seventh embodiment describes a configuration in which a neck portion is provided in an extraction electrode to reduce the absolute number of back scattered electrons, thereby enhancing an effect of preventing minute discharge. An eighth embodiment describes a configuration in which an insulator is formed by a semiconductive material, or a semiconductive or conductive thin film is provided on a surface of the insulator to prevent charging and enhance the effect of preventing the minute discharge. A configuration other than the insulator is the same as that of the first embodiment, and thus description thereof will be omitted.

A SE electron gun of the eighth embodiment will be described with reference to FIG. 13. In the present embodiment, a semiconductive insulator 830 is used instead of the insulator 310 of the first embodiment. The semiconductive insulator 830 is an insulator having an electric conductivity between that of a metal and that of an insulator, and has a volume resistivity of about $10^{10}$ Ωcm to $10^{12}$ Ωcm. By using the semiconductive insulator 830, even when a dark current increases, a voltage difference between the extraction electrode 204 and the suppressor 303 can be maintained. On the other hand, when the back scattered electrons collide with the semiconductive insulator 830, electrons are immediately supplied from the semiconductive insulator 830 in the vicinity thereof even when a surface of the semiconductive insulator 830 is charged, so that charge is alleviated. As a result, electric field emission from the contact point 511 does not occur, and the minute discharge can be prevented.

The same effect can also be achieved by providing a semiconductive coating 831 on a surface of an insulating insulator. The semiconductive coating 831 is a thin film having the volume resistivity of about $10^{10}$ Ωcm to $10^{12}$ Ωcm, and has a thickness of about several μm. Even when the back scattered electrons collide with the semiconductive coating 831, the charging is immediately alleviated, and the minute discharge can be prevented.

The semiconductive coating 831 is not limited to being provided on an entire surface of the insulating insulator, and has the same effect even in a case of being provided on a part of the surface. When the semiconductive coating 831 is provided on a part of the surface, conductivity of the semiconductive coating 831 may be increased, and the volume resistivity may be $10^{10}$ Ωcm or less. When the portion to be covered is limited to a very part of the surface, a conductive metal thin film may be formed, or a film may be formed using metallization. Further, by providing semiconductive or metal coating in the vicinity of the contact point 511, an effect of alleviating electric field concentration at the contact point 511 is added.

Ninth Embodiment

The eighth embodiment describes a configuration in which an insulator is a semiconductive insulator or a semiconductive coating is applied to the insulator to prevent electrification and enhance an effect of preventing minute discharge. A ninth embodiment describes a configuration in which a suppressor is held by a conductive supporting portion and the absolute number of back scattered electrons is reduced to enhance the effect of preventing the minute discharge. That is, the ninth embodiment is an embodiment of a charged particle beam device including an electron gun including: a tip; a suppressor disposed rearward of a distal end of the tip; a conductive supporting portion holding the suppressor; an extraction electrode including a bottom surface and a cylindrical portion and enclosing the tip and the suppressor; an insulator holding the supporting portion and the extraction electrode; and a conductive metal provided between the supporting portion and the cylindrical portion of the extraction electrode, in which a voltage lower than a voltage of the tip is applied to the conductive metal.

The SE electron gun of the ninth embodiment will be described with reference to FIG. 14. A configuration other than the supporting portion is the same as that of the first embodiment, and thus description thereof will be omitted. As shown in the figure, the suppressor 303 according to the present embodiment is held by a supporting portion 840. The supporting portion 840 is a conductive metal cylinder and has a coaxial structure with the suppressor 303. The supporting portion 840 comes into contact with the suppressor 303 and thereby has the same potential as that of the suppressor 303. The supporting portion 840 is held by being fitted to the insulator 310. The insulator 310 and a cylinder of the extraction electrode 204 are held by fitting. As a result, precise positioning and a coaxial structure between the SE tip 202 and the extraction electrode 204 are maintained. A feed-through 841 is connected to the terminal 207, and power is supplied to the filament 206. The shield electrode 301 is provided on a side surface of the supporting portion 840, and covers the lower surface 312 of the insulator 310 together with the cylindrical portion 302.

Also in the present embodiment, a trajectory of the back scattered electrons is controlled by the shield electrode 301 having an integrated structure with the supporting portion 840 of the suppressor 303, and a position at which the back scattered electrons collide with the insulator 310 is separated from the contact point 511. As a result, an increase in an electric field at the contact point 511 due to charging is reduced, and the minute discharge can be prevented. Further, since the supporting portion 840 of the suppressor 303 is provided, a distance between the SE tip 202 and the insulator 310 is increased. As a result, the number of times of collisions until the back scattered electrons reach the insulator 310 is increased, and the absolute number of electrons is reduced so that the minute discharge can be effectively prevented. As described in the present embodiment, the shield electrode 301 may be attached to a component other than the suppressor itself. Further, even when another conductive component is added to the suppressor 303 or the supporting portion 840 and brought into contact with the suppressor 303 or the supporting portion 840, the same effect can be implemented by providing the shield electrode 301 to the additional component.

The invention is not limited to the above-mentioned embodiments, and includes various modifications. For example, the SE tip 202 of the present invention may be a cold cathode electric field emission electron source, a thermal electron source, or a photoexcited electron source. A material of the SE tip 202 is not limited to tungsten, and may be another material such as LaB6, CeB6, or a carbon-based material. Further, the above-mentioned embodiments have been described in detail for easy understanding of the invention, and the invention is not necessarily limited to those including all the configurations described above. A part of a configuration of an embodiment can be replaced with a configuration of another embodiment, and the configuration of another embodiment can be added to the configuration of one embodiment. Further, a part of the configuration of each embodiment may be added to, deleted from, or replaced with another configuration.

REFERENCE SIGN LIST

101 SE electron gun
102 control electrode
103 acceleration electrode
109 turbo-molecular pump
110 condenser lens
111 objective lens
112 sample
113 sample chamber
114 detector
115 electron beam
116 insulator
118 non-evaporable getter pump
119 first vacuum chamber
120 ion pump
121 ion pump
122 ion pump
125 cylindrical body
126 second vacuum chamber
127 third vacuum chamber
128 fourth vacuum chamber
201 SE electron gun in related art
202 SE tip
203 suppressor
204 extraction electrode
205 zirconium oxide
206 filament
207 terminal
208 insulator
209 aperture
210 insulator
301 shield electrode
302 cylindrical portion
303 suppressor
310 insulator
311 gap
312 lower surface
313 upper surface
501 side beam
502 back scattered electron
503 back scattered electron
504 back scattered electron
505 back scattered electron
506 secondary electron
507 surface
510 potential distribution
511 contact point
517 surface
601 narrow path
701 shield electrode
702 suppressor
703 shield electrode
704 suppressor
705 shield electrode
722 cylindrical portion
723 cylindrical portion
801 extraction electrode
802 opening
803 opening
804 back scattered electron
805 back scattered electron
810 side beam
811 back scattered electron
812 side beam
813 protrusion
814 protrusion
815 narrow path
816 back scattered electron
817 back scattered electron
818 back scattered electron
819 back scattered electron
820 insulator
821 extraction electrode bottom portion

822 neck portion
823 narrow path
824 extraction electrode cylindrical portion
830 semiconductive insulator
831 semiconductive coating
840 supporting portion
841 feed-through

The invention claimed is:

1. A charged particle beam device comprising:

an electron gun including: a tip; a suppressor disposed rearward of a distal end of the tip; an extraction electrode including a bottom surface and a cylindrical portion and enclosing the tip and the suppressor; an insulator holding the suppressor and the extraction electrode, wherein a step is provided on an end surface of the insulator, and a gap is provided between the insulator and the cylindrical portion of the extraction electrode; and a conductive metal provided between the suppressor and the cylindrical portion of the extraction electrode, wherein a voltage lower than a voltage of the tip is applied to the conductive metal.

2. The charged particle beam device according to claim 1, wherein a part of the conductive metal is extended to the gap.

3. The charged particle beam device according to claim 2, wherein the conductive metal and the suppressor are integrally formed.

4. The charged particle beam device according to claim 3, wherein the conductive metal has a cylindrical structure, and the cylindrical structure extends in a direction coaxial with the cylindrical portion of the extraction electrode.

5. The charged particle beam device according to claim 3, wherein at least two openings are provided in the extraction electrode.

6. The charged particle beam device according to claim 3, wherein at least one protrusion is provided inside the extraction electrode.

7. The charged particle beam device according to claim 3, wherein an inner diameter of a contact portion between the extraction electrode and the insulator is smaller than an inner diameter of the cylindrical portion of the extraction electrode.

8. The charged particle beam device according to claim 3, wherein the insulator is formed of a semiconductive material, or a semiconductive or conductive thin film is provided on a surface of the insulator.

9. The charged particle beam device according to claim 3, wherein a radius of curvature of the distal end of the tip is set to be larger than 0.5 μm.

10. The charged particle beam device according to claim 3, wherein a vacuum chamber in which the tip is disposed is evacuated by a non-evaporable getter pump.

11. A charged particle beam device comprising:

an electron gun including: a tip; a suppressor disposed rearward of a distal end of the tip; a conductive supporting portion holding the suppressor; an extraction electrode including a bottom surface and a cylindrical portion and enclosing the tip and the suppressor; an insulator holding the supporting portion and the extraction electrode; and a conductive metal provided between the supporting portion and the cylindrical portion of the extraction electrode, wherein a voltage lower than a voltage of the tip is applied to the conductive metal.

12. The charged particle beam device according to claim 11, wherein a step is provided on an end surface of the insulator, and a gap is provided between the insulator and the cylindrical portion of the extraction electrode.

13. The charged particle beam device according to claim 12, wherein a part of the conductive metal is extended to the gap.

* * * * *